US005487546A

United States Patent [19]

Yasuda

[11] Patent Number: 5,487,546

[45] Date of Patent: Jan. 30, 1996

[54] GOLF TRAINING METHOD

[76] Inventor: John P. Yasuda, 18905 Vista Portola Rd., Trabuco Canyon, Calif. 92679

[21] Appl. No.: 399,168

[22] Filed: Mar. 2, 1995

[51] Int. Cl.[6] ..... A63B 69/36

[52] U.S. Cl. ..... 273/187.2; 36/127; 36/167; 36/171; 434/252

[58] Field of Search ..... 273/187.2, 188 R, 273/188 A; 36/127; 434/252

[56] References Cited

U.S. PATENT DOCUMENTS

| | | | |
|---|---|---|---|
| 1,285,882 | 11/1918 | Zielinski . | |
| 2,263,670 | 11/1941 | Arkin . | |
| 2,494,278 | 1/1950 | Badovinac . | |
| 2,498,006 | 2/1950 | Ridill | 273/188 A X |
| 2,847,769 | 8/1958 | Schlesinger | 273/188 A X |
| 3,353,824 | 11/1967 | Hamson, Jr. | 273/26 |
| 3,410,562 | 11/1968 | Lefleur | 273/162 |
| 3,951,407 | 4/1976 | Calacurcio . | |
| 4,058,852 | 11/1977 | Aragona | 273/188 A |
| 4,103,897 | 8/1978 | Ostyn | 273/188 A |
| 4,145,055 | 3/1979 | O'Brien | 273/187 B |
| 4,682,425 | 7/1987 | Simmons | 36/127 X |
| 4,955,608 | 9/1990 | Dougherty et al. | 273/188 A X |
| 5,016,885 | 5/1991 | Quigley | 273/188 R |
| 5,212,894 | 5/1993 | Paparo | 36/127 X |

FOREIGN PATENT DOCUMENTS 1300884 6/1961 France .

OTHER PUBLICATIONS

*The Golf Swing*, David Leadbetter—Author, Copyright 1990, New York, N.Y., pp. 48–55.

*Primary Examiner*—George J. Marlo

*Attorney, Agent, or Firm*—Knobbe, Martens, Olson & Bear

[57] ABSTRACT

A golf instruction aid and method of providing a tactile feedback to a golfer to remind the golfer to observe the proper weight shift during a backswing. The golf instruction aid includes a generally flat main body portion adapted to slip between the instep of the golfer and the golfer's shoe. A first flange extends underneath the foot of the golfer, while a second flange projects outward from the foot of the golfer above the rim of the shoe. The first flange exerts a slight pressure on the instep of the golfer's foot to remind the golfer to maintain his or her weight on the instep during the backswing. In one embodiment, the first flange is positioned generally underneath the second flange and is positioned to apply pressure to the arch of the foot. In the second embodiment, the first flange is positioned forward from the second flange and is positioned to apply pressure to the arch closer to the ball of the foot. The first flange is preferably formed as an arch to provide a concave surface in contact with the foot so the golfer may exert a downward force on the first flange and flatten it.

5 Claims, 3 Drawing Sheets

GOLF TRAINING METHOD

BACKGROUND OF THE INVENTION

Once a certain level of competency is attained, golf can be an extremely relaxing and enjoyable sport. Unfortunately, it is necessary for the beginner to learn numerous fundamentals before reaching any level of consistency. One of the most important fundamentals is to learn a proper weight shift. The proper weight shift involves transferring the weight from both feet to the inside sole of the rear foot during the backswing so that the inside sole of the rear foot can be used to push off, and thereafter transferring the weight to the front foot during the power swing to promote the transfer of weight to the outside of the front foot and through the ball. During the backswing, transfer of weight to the outside of the rear foot instead of the inside, or the failure to transfer weight to the rear foot at all, will result in a poorly struck golf shot.

Unfortunately, this is just one of many aspects of the golf swing that a new golfer must focus on. In fact, U.S. Pat. No. 3,410,562 discloses a golf club with interchangeable reminder buttons which are securable to the shaft of the golf club to remind the golfer of any one of a number of fundamentals. Unfortunately, by overly focusing on one or more of these fundamentals, the golfer tends to become tense, and may lose a sense of natural rhythm necessary for the golf swing.

Accordingly, most instructional aids to insure a proper weight shift have focused on physically restraining the golfer or altering the golfer's stance. Since it is desired to keep the weight of the golfer on the inside of the rear foot, numerous devices have been developed to transfer the weight of the golfer onto that portion of the foot. For example, U.S. Pat. No. 4,145,055 to O'Brien discloses a golf training device simulating a conventional golf ball with an opening which is removably attached to the spike of a golf shoe to lift the outer edge of the foot, thereby preventing significant weight from being transferred to the outer half of the rear foot. Similarly, U.S. Pat. Nos. 4,682,425 and 5,212,894 to Paparo disclose golf shoe insoles which raise the outer portion of the rear foot so that the weight of the golfer will be forced onto the inside portion of the rear foot during the weight transfer. Specifically, Paparo discloses a resilient foam pad sized to cover the heel area of the shoe up to the front of the arch and includes a wedge-shaped lateral cross-sectional area with the thickest portion of the wedge formed along one lateral edge tapering across the insole to the opposite lateral edge. In use, the thicker, lateral edge is positioned toward the outside of the rear foot away from the instep. The instep is conventionally defined as the middle arched portion opening to the inside edge of the foot. Paparo teaches that the purpose of the wedge is to provide tactile pressure sensation to the golfer's rear foot that will consciously and subconsciously result in the proper positioning of the rear foot during the golf swing.

Unfortunately, particularly while walking the golf course over a period of miles, such adapters can be very uncomfortable. While Simmons teaches that the resulting weight transfer is desirable in that it causes different muscle groups to be exercised, it is unclear whether altering the natural walking stride is desirable from a health standpoint. In addition, upon removal of the adapters which physically reposition the foot, the golfer must remember and implement the proper technique while observing the normal flat foot stance. Unfortunately, the stances are quite different and the techniques learned with the adapter in place may not be effectively transferred, once the adaptor is removed.

Another issue is whether wearing an instructional device which physically moves you into the proper stance is proper, regardless of whether it is technically permitted under rules of the local golf association.

Accordingly, an improved instructional aid to assist golfers in promoting a proper weight shift is needed.

SUMMARY OF THE INVENTION

The present invention solves the problems of the prior art by providing a golf swing aid including a generally flat body and a first flange. The body has a length roughly equal to a distance between a top rim surrounding a main opening of a shoe and a portion of an instep of a foot of a wearer within the shoe. The first flange extends generally horizontally inward from the lower portion of the body to exert pressure on the underside of the instep. It has been found that such pressure on the sensitive underside of the instep is extremely helpful in providing a constant reminder of the need to keep the weight of the golfer on the inside of the foot during the transfer of weight onto the back foot. This reminder is desirably reinforced by the pressure of the body of the aid on the side of the foot. Advantageously, this reminder is provided without the user needing to visualize a message and then cognitively interpreting the meaning of the message, thereby distracting the golfer from other aspects of the golf swing.

Whether the pressure acts to directly improve muscle memory or works through the subconscious is not entirely understood. However, experience has shown that the pressure on the instep conveys the desired message without unduly focusing the golfer on this single aspect of the golf swing. Because of the advantageous placement of the first flange under the sensitive arch area, which results in a pleasurable tactical feel, the golfer becomes conditioned over time and will more readily retain and remember the learned techniques of proper weight shift. In this respect, the golfer may retain a subconscious desire to press down on the golf swing aid even after it has been removed.

It will be appreciated that putting a raised portion under the instep is in direct contrast to the teachings of the prior art in which the outside portion of the foot was raised thereby lowering the instep. Advantageously, the first flange defines an upwardly oriented concave surface found to be capable of exerting greater pressure on the instep without causing discomfort. Desirably, the golf swing aid also includes a second flange extending generally horizontally outward from the upper portion of the body which provides a grip to enable the golfer to precisely position the golf aid within the wearer's shoe during use. In addition, this second flange restricts the aid from sliding along the foot within the shoe, or slipping completely into the shoe while walking.

For beginners, it has been determined that it is better for the first flange to press against the instep roughly beneath the ankle bone of the wearer, where the instep is at its most sensitive. However, as the golfer progresses, the golfer no longer needs such a strong reminder to transfer the weight backwards, but wishes to fine tune the location of the front to back position of the center of gravity. Accordingly, a golf swing aid for more advanced players includes a first flange positioned slightly backward from but proximate the ball of the foot of the wearer.

In another aspect of the invention is a method of aiding a golfer to properly transfer weight to an inside portion of a rear foot during a golf swing, including the steps of inserting the rear foot of a golfer into a shoe, inserting a device having a generally flat body and a first flange extending generally horizontally inward from a lower portion of the body into the shoe such that the body extends generally vertically along the vertical wall of the shoe and the first flange extends generally horizontally above the insole of the shoe and bringing the device into contact with the foot so that the device exerts pressure on the underside of the instep of the foot as a reminder to transfer weight to the inside portion of the rear foot. Advantageously, the method further comprises gripping a second flange to position the device with respect to the rear foot.

Another benefit provided by the present invention is that the golf swing aid encourages a proper rotation of the hips relative to the ground. More specifically, many golf professionals recommend the hips swivel no more than 45° to the rear during the backswing. By maintaining the body weight on the inside of the rear foot, which the present golfing aid promotes, the golfer finds swiveling farther than 45° increasingly difficult.

DESCRIPTION OF THE PREFERRED EMBODIMENTS

As described above, one of the most important fundamentals of a golf swing is a proper weight shift. The ideal backswing and ensuing down, or power swing involves pivoting the arms and twisting the hips slightly to the rear. It is desirable that the golfer's weight shift primarily over the golfer's rear leg.

Figure 1:
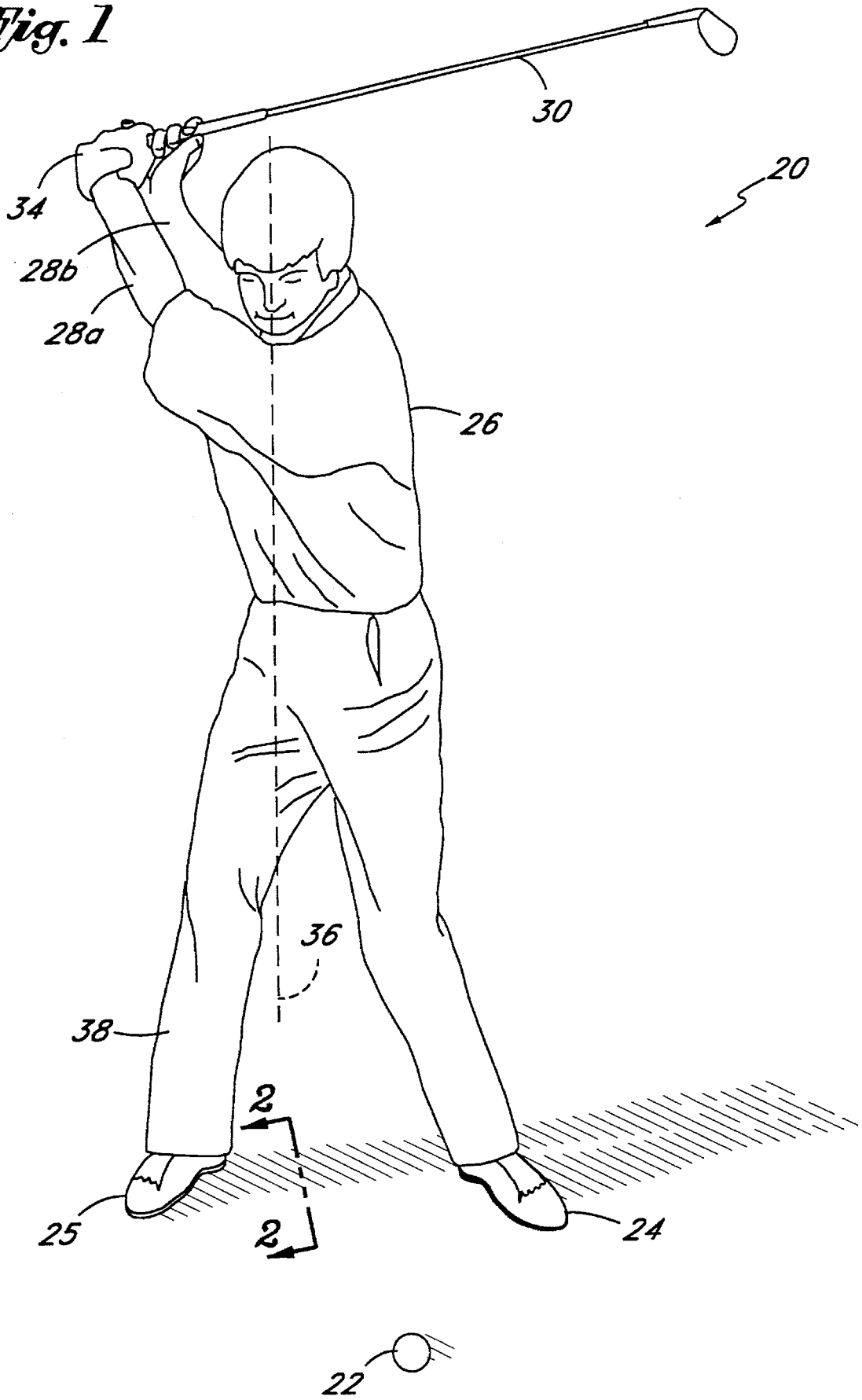
FIG. 1 is a frontal view of a golfer illustrating a correct weight shift of a golfer during a backswing.

FIG. 1 illustrates a golfer 20 in a correct position at the peak of the backswing. The golfer stands facing the ball 22 with the front foot 24 and rear foot 25 spread apart. The golfer's torso 26 is preferably shifted slightly to the rear of a centerline between the front and rear feet 24, 25 (as indicated by the dashed line 36). The left arm 28*a* is brought across the front of the golfer's body by virtue of the shoulders being twisted about the spine so that the golf club 30 is held in the hands 34 above and slightly behind the golfer by the left arm and right arm 28*b*. Although the rear foot 25 remains generally horizontal to the ground, the weight of the golfer, by virtue of the twisting of the abdomen 26 and raising of the arms 28*a,b,* is applied over the rear leg 38 to the inner side of the rear foot 25. Thus, in the ensuing power swing, the golfer efficiently transmits his or her weight forward onto the front foot 24 to apply maximum power to the ball. Unfortunately, this technique is difficult to master as golfer's tend to lean to the rear in the backswing.

Figure 2:
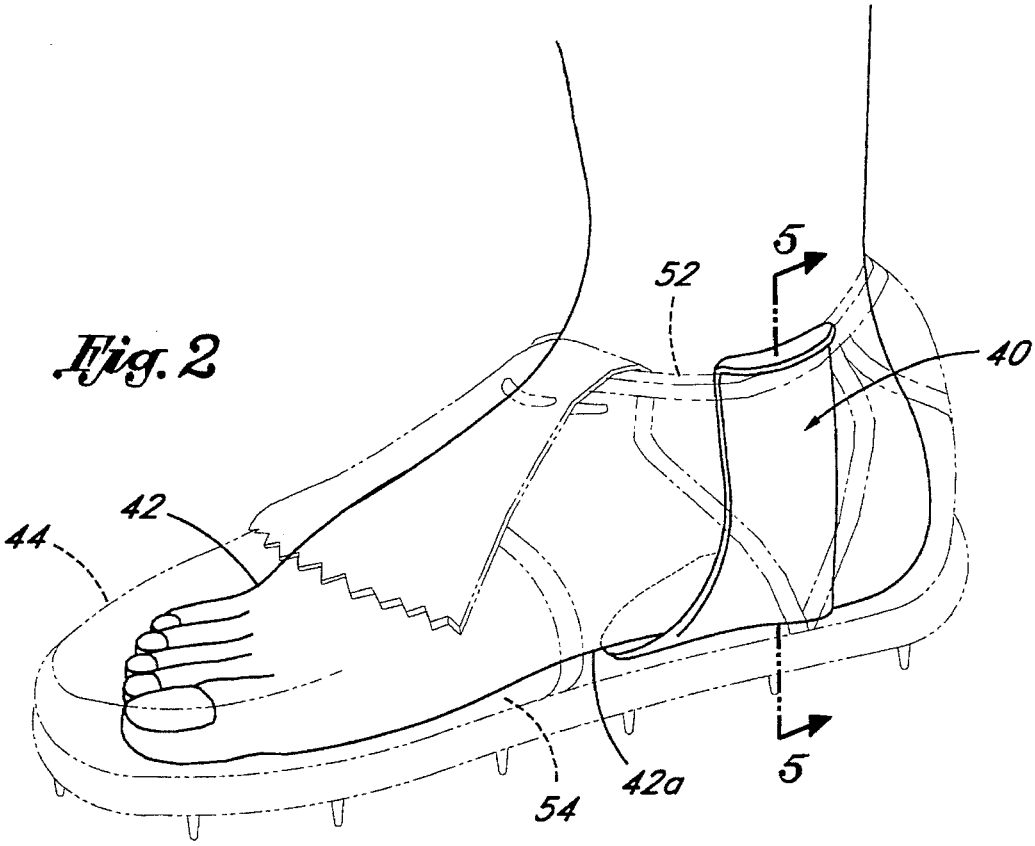
FIG. 2 is a perspective view of an embodiment of a golf instruction aid positioned between a golfer's foot and shoe as seen along the line 2—2 of FIG. 1.

FIG. 2 illustrates an embodiment of a golf instructional aid 40 of the present invention inserted between a golfer's foot 42 and shoe 44. In the illustrated embodiment, the foot 42 and shoe 44 are on the right leg of the golfer, although it will be understood that a mirror image golfing aid 40 can be utilized on the left foot of a left-handed golfer. The golfing aid 40 is positioned within the shoe 44 and adjacent the instep, or the inner side of the arched middle portion, of the foot 42.

Figure 3:
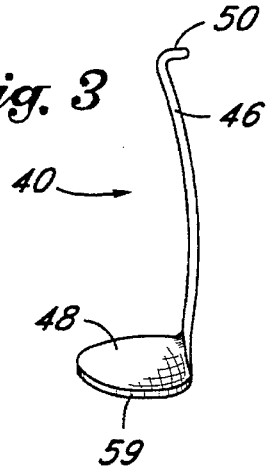
FIG. 3 is a front elevational view of the golf instruction aid shown in FIG. 2.
Figure 4:
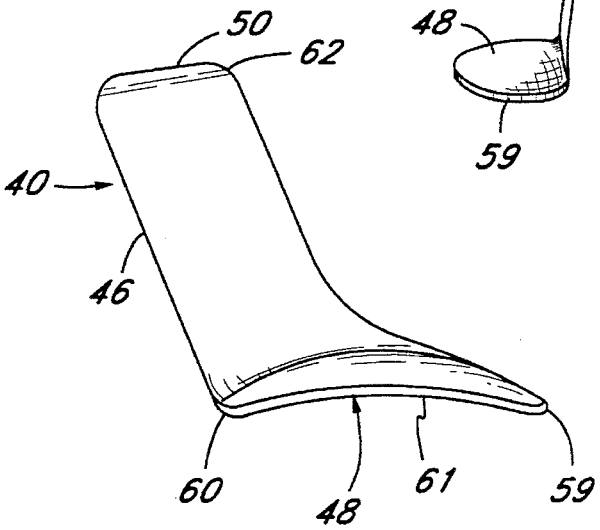
FIG. 4 is a side elevational view of the golf instruction aid shown in FIG. 2.
Figure 5:
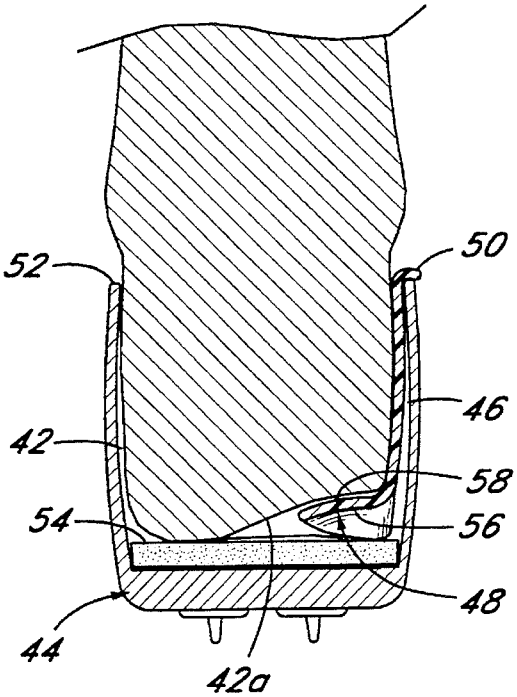
FIG. 5 is a cross-sectional view taken along line 5—5 of FIG. 2 of the golf instruction aid within the golfer's shoe.

Now with reference to FIGS. 3, 4 and 5, a specific shape of the golf instruction aid 40 illustrated in FIG. 2 is shown. The golfing aid generally comprises a generally flat vertical body portion 46, a first flange portion 48, and a second flange portion 50. The vertical body portion 46 is bowed slightly away from the first flange 48 for comfort. The body 46 extends generally from the distance between the rim 52 of the shoe 44 and the insole 54 of the shoe. In this respect, the body portion 46 is oriented generally vertically adjacent the instep of the foot 42 and within the shoe 44. The first flange 48 extends generally horizontally underneath the foot 42 of the golfer between the arch 42*a* and insole 54, while the second flange 50 projects above the shoe rim 52 and extends generally horizontally outward from the foot 42.

The specific placement of the golf instruction aid 50 is intended to provide a tactile reminder to the golfer to maintain his or her weight on the instep of the rear foot during the backswing. In this respect, the golfing aid 50 does not physically restrain the foot 42, but rather simply applies a pressure to the side, instep and sole of the foot. The golfer is thus constantly reminded to maintain his or her weight over the instep of the foot, while not being constrained by any physical restriction, or being distracted by a constant visual reminder. The pressure applied to the inside of the foot at the sensitive arch area conditions the golfer to observe the proper weight shift by generating pleasant sensations every time the golfer applies weight to the instep of the rear foot during the backswing.

From the front, as seen in FIGS. 3 and 5, the body portion 46 is constructed as a relatively thin strip which transitions inward to the first flange 48 on a lower end and outward to the second flange 50 on an upper end. The height of the body portion 46 is designed to extend generally from the insole 54 of the shoe 44 upward to clear the rim 52. The height of the body portion 46 is desirably approximately between 1.5 and 4 inches. The lower first flange 48 extends inward a sufficient distance from the body 46 to contact the instep of the foot 42. Desirably, the first flange 48 extends horizontally inward between ⅜ of an inch and 3 inches, and preferably between ⅜ of an inch and 2 inches. The second flange 50 extends outward a sufficient distance so as to enable the golfer to grip the flange and adjust the position of the golfing aid 40 within the shoe 44, and also to help maintain the correct position of the aid 40 within the shoe 44, but not so far as to get caught on obstructions, such as rocks or branches. In this regard, the second flange 50 preferably extends outward approximately 1/16 of an inch to ¾ of an inch.

With reference to both FIGS. 4 and 5, the first flange 48 is formed as a generally elongated bowl-shaped member with curvatures in two axes. Looking at the cross-section of FIG. 5, the first flange 48 forms a lower concave surface 56, and an upper convex surface 58. Now, looking at the side view of FIG. 4, the first flange 48 exhibits a curvature which terminates in a front end 59 and a rear end 60. Both the front and rear ends 59, 60 are lower than a central portion 61. The front lower end 59 and a rear lower end 60 are positioned to contact the insole 54 of the shoe 44. Desirably, the first flange 48 has a height of at least one-fourth of an inch to ensure that the flange provides adequate pressure on the instep and flexes down when pressure is applied to the instep of the foot. Also, the first flange 48 desirably has a horizontal length between the front end 59 and rear end 60 of at least 2½ inches and preferably less than 5 inches.

The embodiments of the golf aid 40 illustrated in FIGS. 1–5 is intended for use by beginners. In this respect, the shape of the aid 40 is designed so that the first flange 48 is vertically underneath at least a portion of the second flange 50. In other words, the rear end 60 is positioned at or behind a front upper corner 62 of the main body 46. This design positions the first flange 48 generally centrally underneath the arch 42*a* of the golfer's foot 42, preferably beneath the inner protrusion of the ankle bone.

When the golfer applies weight from the foot 42 to the upper concave surface 58 of the first flange 48, the first flange tends to flatten out somewhat due to its resilient nature. At the same time, the first flange 48, being a spring-like member, exerts an upward pressure on the instep of the foot 42. This allows the golfer to walk around the course comfortably with full freedom of movement, without any physical restraint of the foot 42, while still realizing the benefits of the present golfing aid 40 when performing a golf swing. The upward pressure also provides a conditioning sensation to remind the golfer to observe the proper weight shift. This conditioning is retained when the aid 40 is removed.

FIG. 4 illustrates the relative width of the body portion 46. Desirably, the body portion 46 has a width of no more than two inches.

The present golfing aid is intended to apply pressure to a very sensitive portion of the underside of the foot 42. In particular, a plurality of nerve endings terminate in and around the arch 42*a* of the foot. In the leg, the large sciatic nerve extends downward from the spine and branches into the tibial nerve which extends downward into the heel of the foot. The tibial nerve divides into a medial plantar and lateral plantar nerve which extend forward through the foot. All three of the tibial, medial plantar, and lateral plantar nerves exhibit cutaneous branch nerves which terminate proximate the exterior of the sole of the foot. In general, the tibial cutaneous nerves terminate under the heel of the foot, the medial plantar cutaneous nerves terminate underneath the instep portion of the front of the foot, and the lateral plantar cutaneous nerves terminate in the out-step portion of the front of the foot. In the arch of the foot, due to the relatively softer tissue, and thinner cutaneous layer, the nerve endings are especially sensitive to tactile sensation. In addition, both the medial plantar and tibial nerves pick up tactile sensations from the area around the instep side of the arch of the foot. This results in a particularly sensitive portion of the sole of the foot.

The present invention is intended to exploit the sensitive underside of the arch of the foot. In particular, the first flange 48 is sized and positioned to contact the arch of the foot. Furthermore, while this contact provides a reminder to the golfer to maintain the proper weight shift during a backswing, the arch of the foot is softer and "gives" more than other portions of the foot, so that the presence of the first flange 48 is not a great hindrance to walking.

Figure 6:
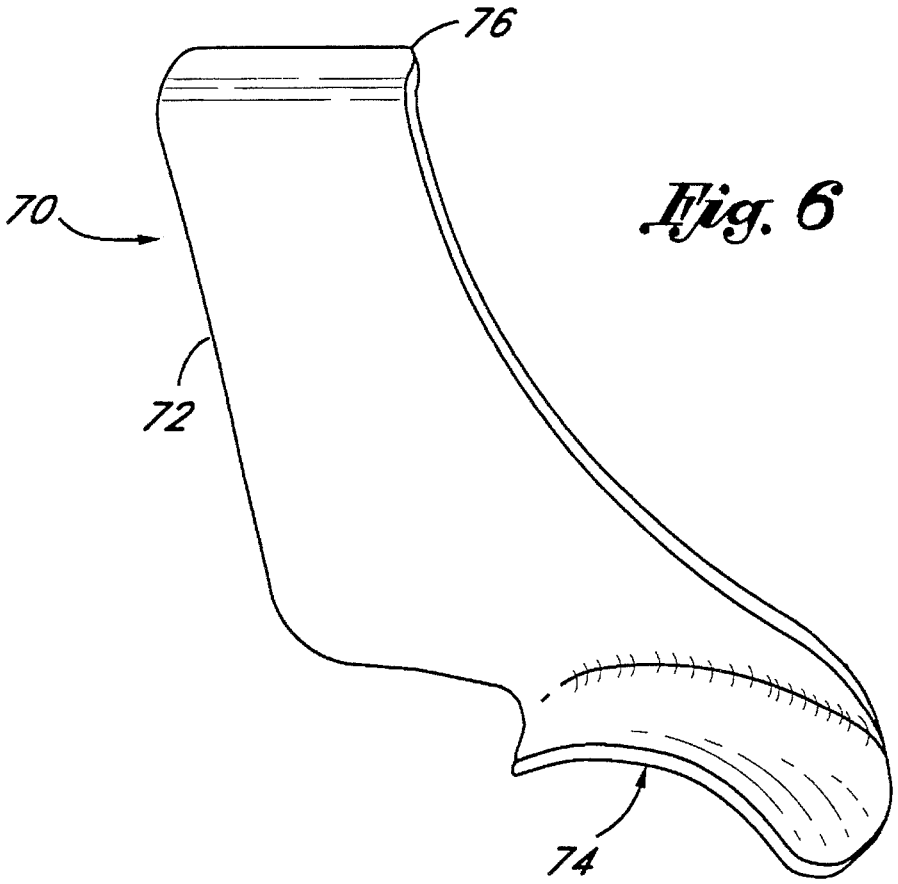
FIG. 6 is a perspective view of a second embodiment of a golf instruction aid of the present invention.
Figure 7:
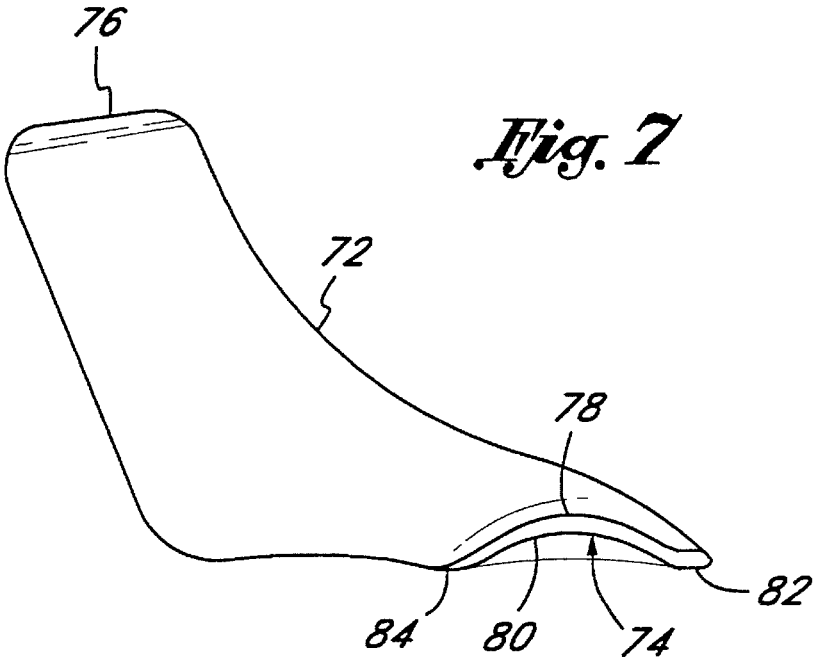
FIG. 7 is a side elevational view of the golf instruction aid of FIG. 6.

FIGS. 6 and 7 illustrate a second embodiment of a golf instruction aid 70. The golf instruction aid 70 comprises a main body portion 72, a lower first flange 74, and an upper second flange 76. In a departure from the first embodiment 40 shown in FIGS. 1–5, the main body portion 72 exhibits a greater forward slant in a downward direction. In this respect, and as best seen in FIG. 7, the first flange 74 is disposed forward from underneath the second flange 76. The first flange 74 is shaped in a similar manner to the first flange 48 of the first embodiment. Namely, the first flange exhibits an upper convex surface 78 and a lower concave surface 80. A first end 82 and a second end 84 contact the insole 54 of the shoe 44.

Due to the greater slant of the main body portion 72, the first flange 76 is positioned proximate the ball of the golfer's foot 42, while still remaining generally under the arch. This is advantageous for instructing more advanced golfers in the proper weight shift during a backswing. Specifically, while this area of the foot is not as sensitive as the area of the instep below the inner protrusion of the ankle bone, more advanced golfers do not need as strong a reminder to transfer their weight onto the inside of the rear foot. On the other hand, ideally the weight should be concentrated on the inside of the rear foot near the ball of the foot for the best push-off and power swing. Thus, the first embodiment 40 of the golfing aid is provided to teach less experienced golfers the proper weight shift during a backswing, while the second embodiment 70 may be utilized by more advanced golfers.

Although this invention has been described in terms of certain preferred embodiments, other embodiments that are apparent to those of ordinary skill in the art are also within the scope of this invention. Accordingly, the scope of the invention is intended to be defined by the claims that follow.

I claim:

1. A method of aiding a golfer to properly transfer weight to an inside portion of a rear foot during a golf swing, comprising:

inserting a rear foot of a golfer into a shoe;

inserting a device having a generally flat body, with a length roughly equal to a distance between a top rim surrounding a main opening of a shoe and a portion of an instep of a foot of a wearer within said shoe, and a first flange extending generally horizontally inward from a lower portion of said body into said shoe such that said body extends generally vertically along a vertical wall of said shoe and said first flange extends generally horizontally above an insole of said shoe;

bringing said device into contact with said foot so that said flange exerts pressure on an underside of said instep of said foot.

2. The method of claim 1, wherein said device is inserted into said shoe prior to said rear foot being inserted into a shoe.

3. The method of claim 1, wherein said device further comprises a second flange extending generally horizontally outward from an upper portion of said body, further comprising gripping said second flange to position said device with respect to said rear foot.

4. The method of claim 1, wherein said device is brought into contact with said foot such that said first flange exerts pressure on said inside of said insole roughly beneath an ankle bone of said golfer.

5. The method of claim 1, wherein said device is brought into contact with said foot such that said first flange exerts pressure on said inside of said insole proximate a ball of said foot of said golfer.

* * * * *

UNITED STATES PATENT AND TRADEMARK OFFICE

CERTIFICATE OF CORRECTION

PATENT NO. : 5,487,546

DATED : January 30, 1996

INVENTOR(S) : Yasuda

It is certified that error appears in the above-indentified patent and that said Letters Patent is hereby corrected as shown below:

Column 6, Line 47, Claim 1, reads "said flange", but should read --said first flange--;

Signed and Sealed this

Sixth Day of August, 1996

*Attest:*

*Attesting Officer*

BRUCE LEHMAN

*Commissioner of Patents and Trademarks*